US006451270B1

(12) United States Patent
Killian et al.

(10) Patent No.: US 6,451,270 B1
(45) Date of Patent: Sep. 17, 2002

(54) BRINE MAKER WITH REMOVABLE HOPPER

(75) Inventors: Mark Killian, Urbandale; Scott Killian; Robert Killian, both of Johnston, all of IA (US)

(73) Assignee: Sprayer Specialties, Inc., Grimes, IA (US)

( * ) Notice: Subject to any disclaimer, the term of this patent is extended or adjusted under 35 U.S.C. 154(b) by 0 days.

(21) Appl. No.: 09/864,634

(22) Filed: May 25, 2001

(51) Int. Cl.[7] ..... B01F 1/00

(52) U.S. Cl. ..... 422/261; 422/255; 422/2; 137/1; 137/268

(58) Field of Search ..... 422/261, 2; 137/1, 137/268

(56) References Cited

U.S. PATENT DOCUMENTS 3,800,026 A 3/1974 Morgan
3,936,274 A 2/1976 Leverenz et al.
5,169,406 A 12/1992 Tewari
5,819,776 A * 10/1998 Kephart ..... 137/1
5,997,099 A * 12/1999 Collins ..... 298/29

* cited by examiner

*Primary Examiner*—Terrence R. Till
*Assistant Examiner*—Sean E. Conley
(74) *Attorney, Agent, or Firm*—G. Brian Pingel; Camille L. Urban

(57) ABSTRACT

The present invention is a brine-maker of a two-tank arrangement specifically designed for efficient removal of salt sludge. The first tank is a salt-hopper into which water flows from the bottom and up through salt to form brine and leaves mineral impurities called sludge on the bottom of the hopper. The brine then overflows through strainers into a brine containment tank. The outside of the salt hopper has bracketing means attached. When the sludge needs to be removed, a lifting device is attached to the bracketing means and the hopper is disconnected from the water supply by a quick-fit coupler and removed to a dumping site where it is turned on its side and the sludge is poured out. The salt hopper is then returned to its position and coupled to the water supply. The salinity level of the brine in the containment tank can be adjusted either by adding fresh water or by running the brine back through the salt in the salt hopper. The brine is stored in the brine containment tank until discharged for use.

15 Claims, 3 Drawing Sheets

BRINE MAKER WITH REMOVABLE HOPPER

BACKGROUND OF THE INVENTION

1. Field of the Invention

The present invention relates to the production of brine solutions primarily used to improve winter road conditions and, more particularly to a two-tank brine maker specially designed for ease in cleaning sludge out of the brine maker that is the result of the process.

2. Description of the Prior Art

It has long been known that applying salt to icy roads will greatly reduce the amount of ice on the roads and the amount of ice that will form. In the fairly recent past, devices have been designed to produce a salt solution or brine to be sprayed on road surfaces for the prevention and reduction of ice formation.

In general, brine makers either function by adding water on top of a salt bed and letting it flow downward to drain through an outlet at the bottom or by adding water from below the salt bed and forcing it to flow upward and through an overflow near the top. In either process, the salt dissolves but the impurities in the salt remain at the bottom of the container where the salt is dissolved and form a sludge. The sludge will continue to increase and must be cleaned out from the brine maker periodically.

Different approaches have been developed in order to address the need to remove the build up of sludge. The simplest of these requires an opening in the bottom of the tank which is closed during brine making. To clean the tank, the opening is uncovered and men get in the tank with brooms and a water hose. They proceed to use the water to wet the sludge and then sweep it through the opening. This is a labor and time-intensive technique.

Another approach to cleaning a brine maker is found in U.S. Pat. No. 3,800,026 which shows a conically shaped bottom portion of a salt hopper with an outlet. The outlet is connected to a pump. The brine processing is shut down and water is pumped into the bottom of the salt hopper and the sludge is flushed out and then sent to a separator and the liquid is returned. However, this arrangement requires a relatively complex arrangement and additional space. Another approach is described in U.S. Pat. No. 3,936,274 which includes a salt bed supported above a conically shaped bottom. To remove sludge, the influx of water is stopped and a valve near the bottom of the conical shape is opened to let sludge flow out. Yet another approach describes a clearing method wherein the inside of the tank is provided with spray nozzles connected to the water supply. The brine making process is stopped and the nozzles are turned on so that the sides of the tank are washed and the sludge becomes a slurry which is then pumped out of the tank. (See U.S. Pat. No. 5,169,406). All of these methods contemplate a salt hopper in a stationary and fixed position and consequently require a reservoir in which to dump the slurry to be located adjacent to the hopper.

One object of the present invention is to eliminate or at least greatly reduce the number of man-hours required to make brine;

A second object of the present invention is to provide a compact and simple device for making brine;

A third object of the present invention is to provide a brine maker from which the sludge can easily and quickly be removed;

A final object of the present invention is to provide a brine maker which does not necessarily have to be positioned adjacent to a reservoir in which to dump the slurry.

SUMMARY

To accomplish the foregoing objectives the present invention comprises a brine maker of a two-tank arrangement including a salt hopper where brine is made and a brine storage tank. In one embodiment the tanks sit on a frame side by side so that an upper portion of the salt hopper is higher than an upper portion of the brine storage tank. As in other brine making devices, a water inlet is provided in a bottom portion of the salt hopper and a valve means is attached to a water supply so that water can be directed into the salt hopper and through a manifold which distributes the water along the bottom of the salt hopper. In the present invention the water supply is connected to the salt hopper through a quick-fit coupler and a water supply shut off. The quick-fit coupler is easily and quickly decoupled. Near the upper portion of the salt hopper is an opening through which brine will overflow into and through a filtering means attached to the upper portion of the salt hopper. The filter is positioned such that brine flowing through it pours into the brine storage tank.

The salt hopper of the present invention has a bottom and external and internal surfaces of a front wall and a back wall. In one embodiment, the bottom is planar and the front wall is angled at more than 90 degrees from the bottom's plane. This angle allows for ease in removing sludge. The hopper is further provided with bracketing means attached to the external surface of the front wall. When the salt hopper needs to be cleaned, the water supply is turned off, the water inlet is closed and the water supply is removed from the salt hopper by decoupling the quick-fit coupler. A forklift or other such device is attached to the bracketing means on the hopper front wall and the hopper is then lifted off the frame, taken to a dumping area, and turned over to remove sludge. The salt hopper is then returned and set onto the frame and the water supply re-coupled.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
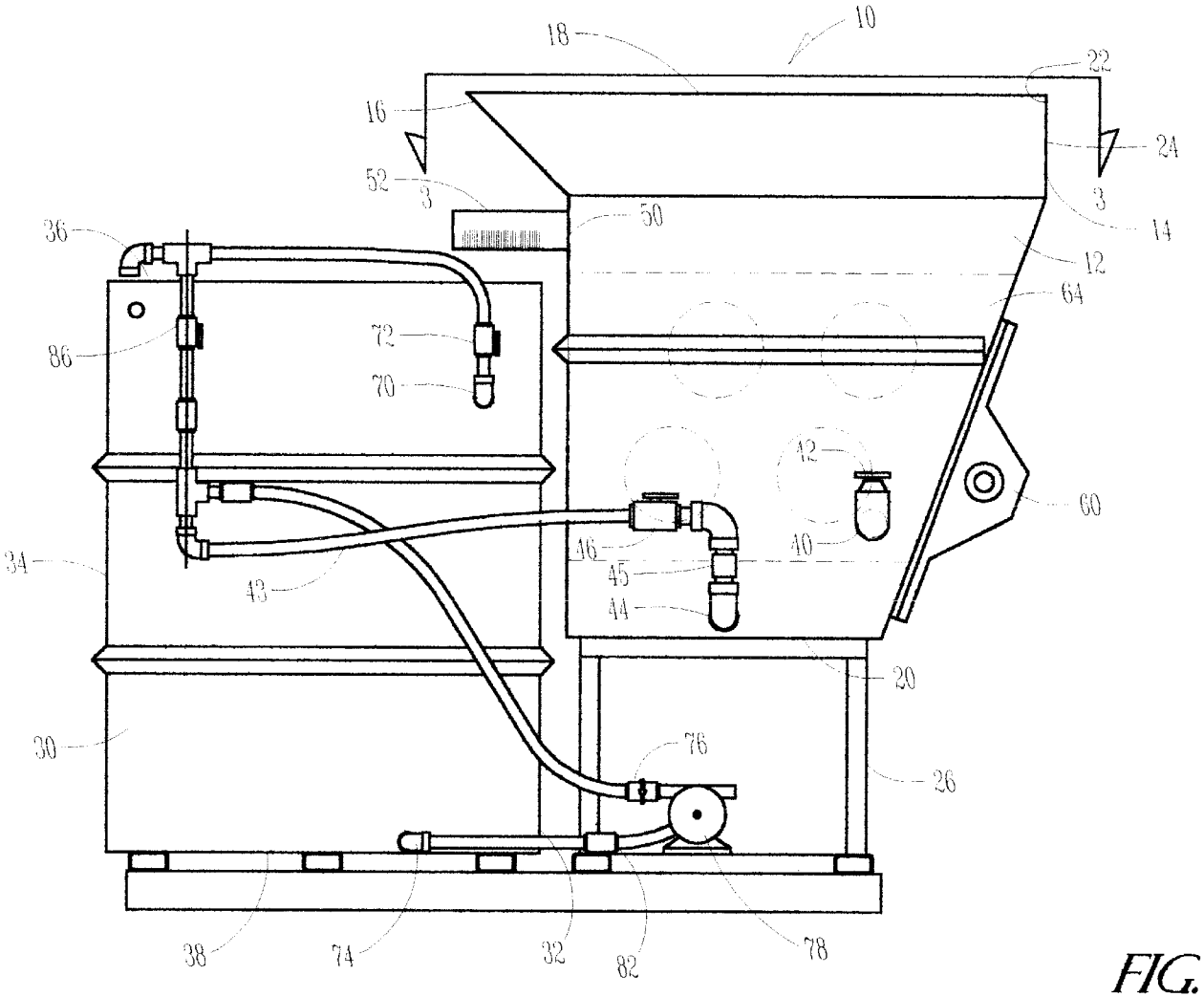
FIG. 1 is a perspective view of one end of the brine maker of the present invention.

With reference to the drawings, a brine maker in accordance with the present invention is shown generally as 10 in FIG. 1. The brine maker 10 is provided with a salt hopper 12 comprising a front wall 14 a back wall 16 a top edge 18 and a bottom 20 and an interior 22 and an exterior 24. The salt hopper 12 sits upon a frame 26 and adjacent to a brine containment tank 30 comprising a front wall 32, a back wall 34, a top edge 36 and a bottom 38.

Figure 2:
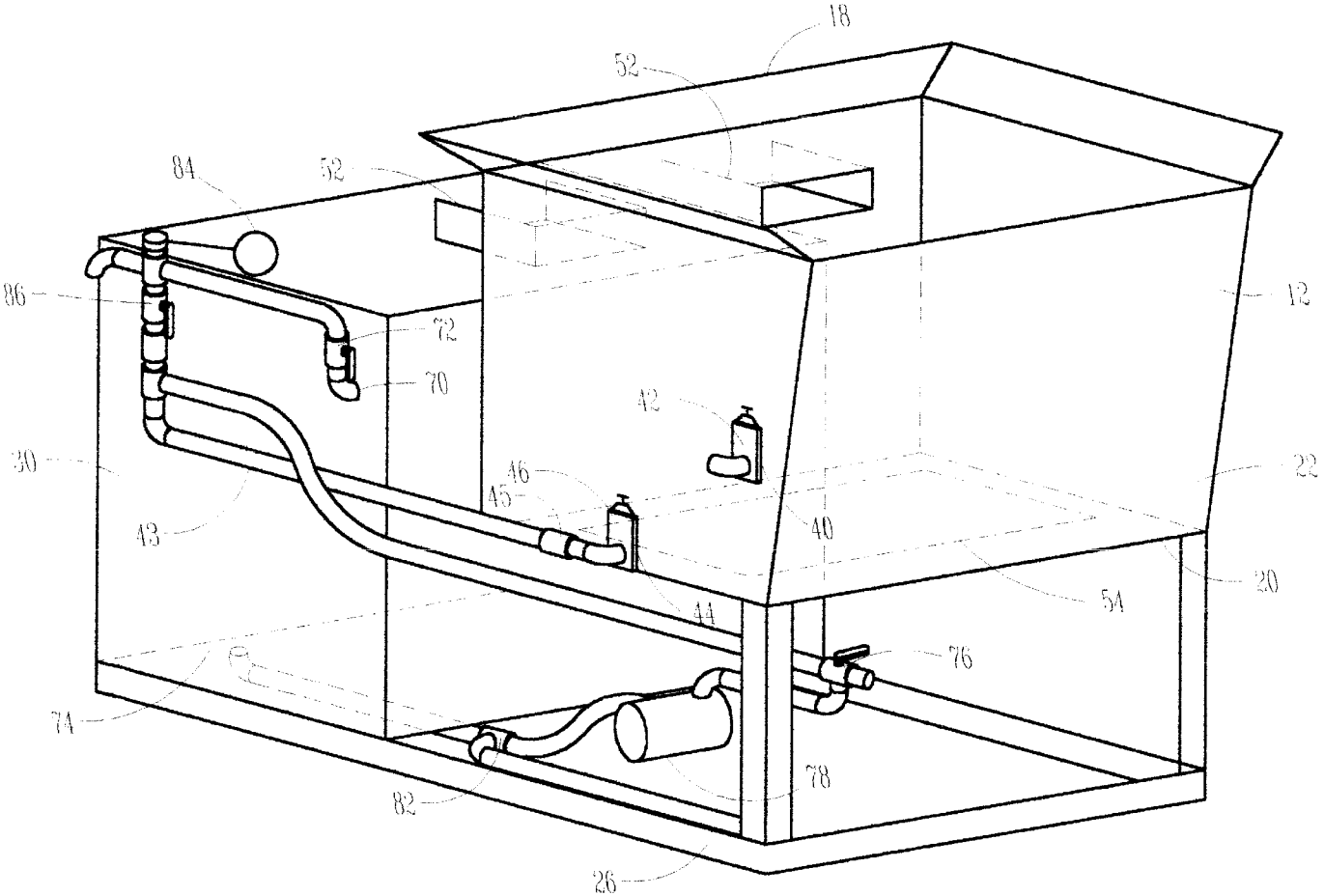
FIG. 2 is a front view of the present invention specifically showing a means to connect a lifting device.
Figure 3:
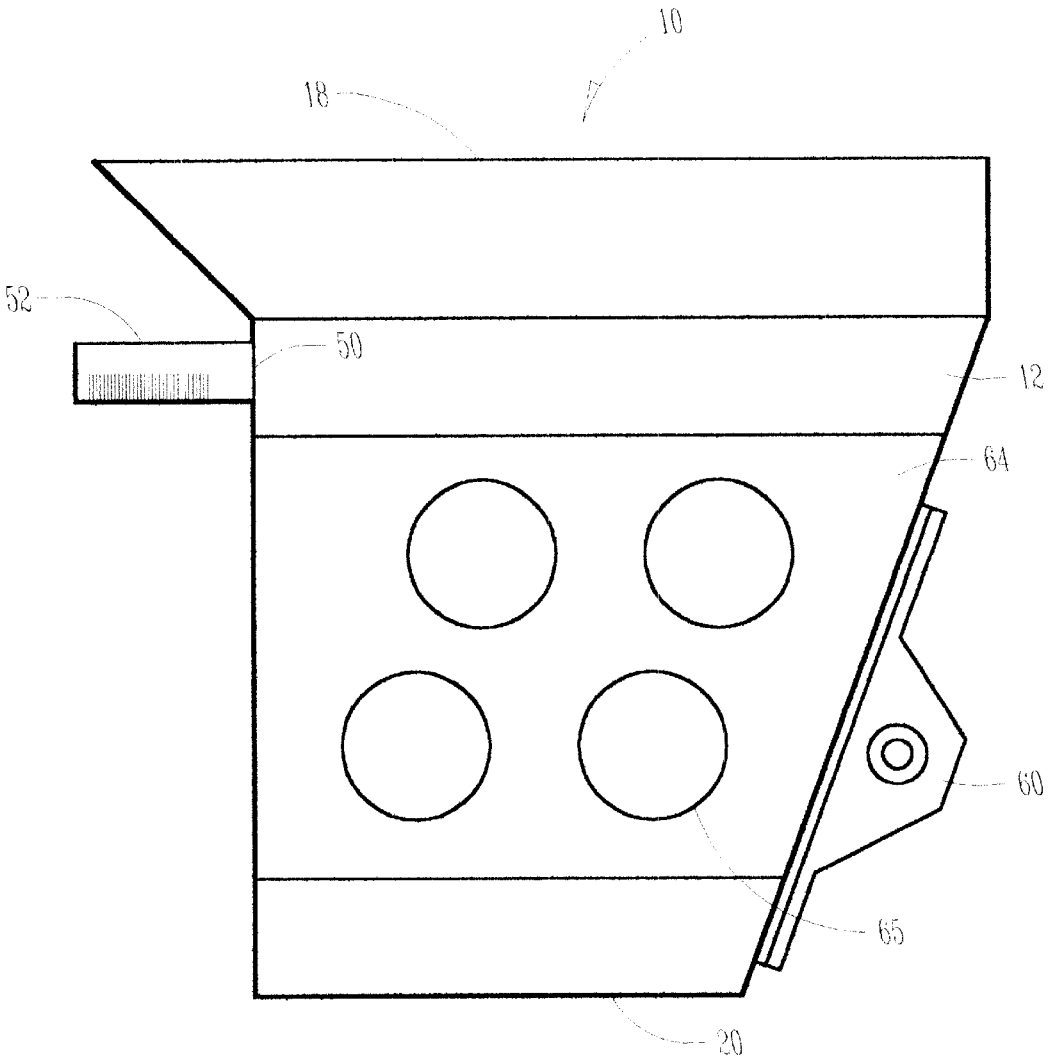
FIG. 3 is a cut-away along line 3—3 in FIG. 1 showing the interior of the salt hopper.

The salt hopper 12 is further provided a liquid drain off outlet 40 with a first shut off 42, a water inlet 44 with a water supply line 43, a quick-fit coupler 45, and a water supply shut off valve 46. The water flow in the supply line 43 is controlled by a valve 86. Said water inlet 44 provides water to a manifold 54 (seen in FIG. 2) which is located on the bottom 20 of the interior 22 of the salt hopper 12. The hopper 12 is further provided with an opening 50 on the back wall of said hopper 12 from which two overflow strainers 52 protrude to overhang the top edge 36 of the brine containment tank 30. FIGS. 1 and 3 show that mounted on said front wall 14 of said salt hopper 12 is a bracketing means 60 to attach said hopper 12 to a lifting device (not illustrated). The interior 22 of the salt hopper 12 is strengthened by at lest one baffle 64 (better shown in FIG. 3) positioned perpendicular to and between said front wall 14 and said back wall 16 of the salt hopper 12. The baffle 64 includes openings 65 to facilitate the flow of brine.

The brine containment tank 30 shown best in FIG. 1, further comprises a fresh water inlet 70 equipped with a water add valve 72, and an opening 74 near or on the bottom 38 that is associated with a bidirectional valve 76 which is connected to a pumping means 78. Opening 74 is also associated with a clean out valve 82 and further associated with the pumping means 78. A float assembly 84 shown in FIG. 2 is attached near said top edge 36 of said brine containment tank 30 and associated with valve 86 and, further, said water supply line 43 of said salt hopper 12.

In operation, salt is placed in the salt hopper 12 and water is added through the water inlet 44 by opening the water supply shut off valve 46. As water rises through the salt, brine is formed. With time, the brine level rises high enough in the salt hopper 12 that it overflows through the opening 50 and through the strainers 52 to pour into the brine containment tank 30. Some impurities may rise with the brine level and can be removed from the open-topped strainers 52 simply by scooping it out. This continues until the brine level reaches the float assembly 84 in the brine containment tank 30 which closes the valve 86 on the water supply line 43.

Depending on the purity of the salt, a certain amount of sludge will form at the bottom 20 of the salt hopper 12. When the sludge needs to be removed, the water supply is turned off and the water supply shut off valve 46 is closed and the salt hopper 12 is drained to the level of the liquid drain off outlet 40 by opening the first shut off valve 42. Next, the quick-fit coupler 45 is unfastened to disconnect the water supply line 43 from the salt hopper 12. A lifting device is attached to the salt hopper 12 by bracketing means 60 and removed from the frame 26 to a dumping area, tipped to disgorge sludge and then righted and returned to the frame 26. The front wall 14 of said salt hopper 12 is angled out from the bottom 20 in order to better remove sludge.

The brine in the containment tank 30 can be checked for salinity level and fresh water added through the inlet 70 if the level is too high. If the level is too low, the bidirectional valve 76 can be turned and the pumping means 78 activated to send the brine back to the salt hopper 12 and through the salt. Brine can be removed for use from the brine containment tank 30 by turning the bidirectional valve 76 the opposite way and opening clean-out valve 82. The brine containment tank 30 can be emptied for cleaning or maintenance also by opening the clean-out valve 82.

Thus, the present invention has been described in an illustrative manner. It is to be understood that the terminology that has been used is intended to be in the nature of words of description rather than of limitation.

Many modifications and variations of the present invention are possible in light of the above teachings. For example, although the drawings show the tanks sitting on a frame, the frame is not necessary for the function of the brine maker. Therefore, within the scope of the appended claims, the present invention may be practiced otherwise than as specifically described.

What is claimed is:

1. A brine maker comprising:

a) a salt hopper with a connection to a water supply;

b) a brine containment tank near the salt hopper;

c) at least one brine overflow strainer;

d) means to empty said brine containment tank;

e) means to disconnect said salt hopper from said water supply; and f) means to connect said salt hopper to a lifting device so that said hopper can be lifted, moved and tipped into a dumping position to remove waste materials from said hopper without moving said brine containment tank.

2. A brine maker as claimed in claim 1 wherein said salt hopper comprises a front wall, a backwall, a bottom surface, a connection to a water supply, an outer surface, and a baffle member comprising at least one opening and positioned perpendicular to and between said front wall and said back wall of the salt hopper.

3. A brine maker as claimed in claim 1 wherein said brine containment tank further comprises:

a) a water inlet and a water add valve;

b) a clean-out opening and a clean out valve;

c) means to empty said containment tank comprises a means to pump brine through a clean out opening;

d) means to increase salinity comprising associating said clean-out outlet with a bidirectional valve which is further associated with said connection to water supply of said salt hopper for diverting brine in said containment tank back to said salt hopper.

4. A brine maker comprising:

a) a frame;

b) a salt hopper comprising a front wall, a backwall, a bottom surface, a connection to a water supply, and an outer surface;

c) a brine containment tank comprising an inner surface and an outer surface;

d) at least one brine overflow strainer;

e) means to empty said containment tank;

f) means to increase and decrease salinity in said containment tank;

g) means to disconnect said salt hopper from said water supply;

h) means to connect said salt hopper to a lifting device so that said hopper can be lifted moved and tipped into a dumping position to remove waste materials from said hopper; and i) said front wall and said bottom of said salt hopper form more than a 90 degree angle relative to one another to facilitate dumping.

5. A brine maker as claimed in claim 4 wherein each said overflow strainer comprises:

a) a rectangular tray-like structure with a bottom, an end and two sides;

b) a plurality of generally parallel slat-like openings extending across said bottom and into at least a portion of each of said two sides.

6. A brine maker as claimed in claim 4 wherein said salt hopper further comprises a top edge and two sidewalls and said brine containment tank further comprises a bottom surface, a top edge, and four sidewalls.

7. A brine maker as claimed in claim 6 wherein said frame is constructed such that said salt hopper and said brine containment tank are positioned with one of said four sidewalls of said brine containment tank generally parallel to said back wall of said salt hopper and said top edge of said brine containment tank is lower than said top edge of said salt hopper.

8. A brine maker as claimed in claim 4 wherein said salt hopper includes an interior and an exterior and a baffle member comprising at least one opening and positioned in said interior perpendicular to said front wall and to said back wall of the salt hopper.

9. A brine maker as claimed in claim 4 wherein said means to connect said salt hopper to a lifting device comprises a bracket mounted on said front wall of said salt hopper.

10. A brine maker as claimed in claim 7 wherein said brine containment tank further comprises:

a) a water inlet and a water add valve;

b) a clean-out opening and a clean out valve; and c) means to empty said containment tank further comprises a means to pump brine through said clean out opening.

11. A brine maker as claimed in claim 10 wherein said means to empty said containment tank and means to increase salinity comprises associating said clean-out outlet with a bidirectional valve which is further associated with said connection to water supply of said salt hopper.

12. A brine maker as claimed in claim 10 wherein said brine containment tank further comprises a float apparatus associated with said connection to said water supply for said salt hopper.

13. A brine maker as claimed in claim 4 wherein said connection to a water supply of said salt hopper further comprises a water supply line, a quick-fit coupler, a shut off valve, and a manifold for distributing water in said salt hopper.

14. A brine maker as claimed in claim 6 wherein said salt hopper further comprises a protruding lip above said top edge of said salt hopper above said back wall to protect said overflow strainer and facilitate removal of waste materials from said salt hopper.

15. A brine maker of a two-tank arrangement comprising:

a) a salt hopper further comprising a front wall, a bottom, a top edge, a liquid-drain off opening associated with a first valve, and a water inlet associated with a shut off valve and a quick-fit coupler;

b) a brine containment tank further comprising a top edge, a first opening associated with a second valve, and a second opening associated with a bidirectional valve;

c) means to filter brine comprising a strainer with a bottom and three sidewalls and further comprising parallel slat-like openings extending across said bottom and partially into at least one said sidewall and attached to said top edge of said salt hopper;

d) means to position said top edge of said salt hopper above said top edge of said brine containment tank comprising a frame;

e) means to lower salinity in said brine containment tank further comprising a water supply associated with said second valve;

f) means to raise salinity in said brine containment tank comprising a pumping means associated with said bidirectional valve and further associated with said water inlet and said shut off valve in said salt hopper; and e) means to attach a lifting device to said salt hopper comprising a bracket attached to said front wall of said salt hopper.

* * * * *